United States Patent [19]

Dappen et al.

[11] Patent Number: 5,015,566

[45] Date of Patent: May 14, 1991

[54] TABULAR GRAIN PHOTOGRAPHIC ELEMENTS EXHIBITING REDUCED PRESSURE SENSITIVITY (II)

[75] Inventors: Glen M. Dappen; Wayne A. Bowman, both of Rochester, N.Y.

[73] Assignee: Eastman Kodak Company, Rochester, N.Y.

[21] Appl. No.: 488,188

[22] Filed: Mar. 5, 1990

Related U.S. Application Data

[63] Continuation-in-part of Ser. No. 241,665, Sep. 8, 1988, abandoned.

[51] Int. Cl.[5] ..... G03C 1/04

[52] U.S. Cl. ..... 430/567; 430/569; 430/628

[58] Field of Search ..... 430/567, 569, 628

[56] References Cited

U.S. PATENT DOCUMENTS

| | | | |
|---|---|---|---|
| 3,000,741 | 9/1961 | DePauw et al. | 430/569 |
| 3,512,995 | 5/1970 | Harvey | 430/596 |
| 3,536,491 | 10/1970 | Rees et al. | 430/628 |
| 3,554,987 | 1/1971 | Smith | 430/567 |
| 3,576,628 | 4/1971 | Beavers | 430/628 |
| 3,647,459 | 3/1972 | Taber et al. | 430/628 |
| 4,386,156 | 5/1983 | Mignot | 430/567 |
| 4,399,215 | 8/1983 | Wey | 430/567 |
| 4,400,463 | 8/1983 | Maskasky | 430/434 |
| 4,414,304 | 11/1983 | Dickerson | 430/353 |
| 4,414,306 | 11/1983 | Wey et al. | 430/434 |
| 4,414,310 | 11/1983 | Daubendiek et al. | 430/567 |
| 4,425,425 | 1/1984 | Abbott et al. | 430/502 |
| 4,425,426 | 1/1984 | Abbott et al. | 430/502 |
| 4,433,048 | 2/1984 | Solberg et al. | 430/434 |
| 4,434,226 | 2/1984 | Wilgus et al. | 430/569 |
| 4,435,499 | 3/1984 | Reevs | 430/350 |
| 4,435,501 | 3/1984 | Maskasky | 430/434 |
| 4,439,520 | 3/1984 | Kofron et al. | 430/567 |
| 4,478,928 | 10/1984 | Jones et al. | 430/217 |
| 4,504,570 | 3/1985 | Evans et al. | 430/217 |
| 4,520,098 | 5/1985 | Dickerson | 430/495 |
| 4,643,966 | 2/1987 | Maskasky | 430/567 |
| 4,656,122 | 4/1987 | Sowinski et al. | 430/505 |
| 4,665,012 | 5/1987 | Sugimoto et al. | 430/569 |
| 4,672,027 | 6/1987 | Daubendiek et al. | 430/505 |
| 4,684,607 | 8/1987 | Maskasky | 430/567 |
| 4,693,964 | 9/1987 | Daubendiek et al. | 430/505 |
| 4,713,320 | 12/1987 | Maskasky | 430/567 |
| 4,713,323 | 12/1987 | Maskasky | 430/569 |

OTHER PUBLICATIONS

Research Disclosure, vol. 176, Jan. 1978, Item 17643, Section IX.

Research Disclosure, vol. 195, Jul. 1980, Item 19551.

*Primary Examiner*—Charles L. Bowers, Jr.

*Assistant Examiner*—Thorl Chea

*Attorney, Agent, or Firm*—Carl O. Thomas

[57] ABSTRACT

A photographic element is disclosed comprised of a support and, coated on the support, at least one radiation-sensitive silver halide emulsion comprised of tabular silver halide grains and a dispersing medium. The emulsion includes as a vehicle methacrylate polymer latex capable of reducing pressure sensitivity having a glass transition temperature of less than 50° C.

13 Claims, No Drawings

TABULAR GRAIN PHOTOGRAPHIC ELEMENTS EXHIBITING REDUCED PRESSURE SENSITIVITY (II)

This is a continuation-in-part of U.S. Ser. No. 241,665, filed Sept. 8, 1988, now abandoned.

FIELD OF THE INVENTION

The invention relates to photography. More specifically, the invention relates to an improvement in silver halide photographic elements.

BACKGROUND OF THE INVENTION

Silver halide photography has benefitted in this decade from the development of tabular grain emulsions. As employed herein the term "tabular grain emulsion" designates any emulsion in which at least 50 percent of the total grain proJected area is accounted for by tabular grains. Whereas tabular grains have long been recognized to exist to some degree in conventional emulsions, only recently has the photographically advantageous role of the tabular grain shape been appreciated.

Tabular grain emulsions exhibiting particularly advantageous photographic properties include (i) high aspect ratio tabular grain silver halide emulsions and (ii) thin, intermediate aspect ratio tabular grain silver halide emulsions. High aspect ratio tabular grain emulsions are those in which the tabular grains exhibit an average aspect ratio of greater than 8:1. Thin, intermediate aspect ratio tabular grain emulsions are those in which the tabular grain emulsions of a thickness of less than 0.2 μm have an average aspect ratio in the range of from 5:1 to 8:1.

The common feature of high aspect ratio and thin, intermediate aspect ratio tabular grain emulsions, hereinafter collectively referred to as "recent tabular grain emulsions", is that tabular grain thickness is reduced in relation to the equivalent circular diameter of the tabular grains. Most of the recent tabular grain emulsions can be differentiated from those known in the art for many years by the following relationship:

$$ECD/t^2 > 25 \quad (1)$$

where

ECD is the average equivalent circular diameter of the tabular grains and t is the average thickness of the tabular grains.

The term "equivalent circular diameter" is employed in its art recognized sense to indicate the diameter of a circle having an area equal to that of the projected area of a grain, in this instance a tabular grain. In keeping with the established practice in the art, both ECD and t are measured in micrometers (μm). All tabular grain averages referred to are to be understood to be number averages, except as otherwise indicated.

Since the average aspect ratio of a tabular grain emulsion satisfies relationship (2):

$$AR = ECD/t \quad (2)$$

where

AR is the average tabular grain aspect ratio and

ECD and t are as previously defined, it is apparent that relationship (1) can be alternatively written as relationship (3):

$$AR/t > 25 \quad (3)$$

Relationship (3) makes plain the importance of both average aspect ratios and average thicknesses of tabular grains in arriving at preferred tabular grain emulsions having the most desirable photographic properties.

The following illustrate recent tabular grain emulsions satisfying relationships (1) and (3):

| | | | |
|---|---|---|---|
| R-1 | U.S. Pat. No. | 4,386,156, | Mignot; |
| R-2 | U.S. Pat. No. | 4,399,215, | Wey; |
| R-3 | U.S. Pat. No. | 4,400,463, | Maskasky; |
| R-4 | U.S. Pat. No. | 4,414,304, | Dickerson; |
| R-5 | U.S. Pat. No. | 4,414,306, | Wey et al; |
| R-6 | U.S. Pat. No. | 4,414,310, | Daubendiek et al; |
| R-7 | U.S. Pat. No. | 4,425,425, | Abbott et al; |
| R-8 | U.S. Pat. No. | 4,425,426, | Abbott et al; |
| R-9 | U.S. Pat. No. | 4,433,048, | Solberg et al; |
| R-10 | U.S. Pat. No. | 4,434,226, | Wilgus et al; |
| R-11 | U.S. Pat. No. | 4,435,499, | Reeves; |
| R-12 | U.S. Pat. No. | 4,435,501, | Maskasky; |
| R-13 | U.S. Pat. No. | 4,439,520, | Kofron et al; |
| R-14 | U.S. Pat. No. | 4,478,929, | Jones et al; |
| R-15 | U.S. Pat. No. | 4,504,570, | Evans et al; |
| R-16 | U.S. Pat. No. | 4,520,098, | Dickerson; |
| R-17 | U.S. Pat. No. | 4,643,966, | Maskasky; |
| R-18 | U.S. Pat. No. | 4,656,122, | Sowinski et al; |
| R-19 | U.S. Pat. No. | 4,672,027, | Daubendiek et al; |
| R-20 | U.S. Pat. No. | 4,684,607, | Maskasky; |
| R-21 | U.S. Pat. No. | 4,693,964, | Daubendiek et al; |
| R-22 | U.S. Pat. No. | 4,713,320, | Masasky; and |
| R-23 | U.S. Pat. No. | 4,713,323, | Masasky. |

All of these patents disclose photographic elements containing at least one tabular grain emulsion layer the vehicle of which contains a latex. R-3 requires precipitation of the tabular grains in the presence of a peptizer continuous phase which can be an acrylate or methacrylate polymer modified by the inclusion of thioether pendant groups. R-11 discloses vehicles particularly adapted for photothermography. R-22 and R-23 disclose the use of "oxidized" (low methionine) gelatin as a peptizer. Otherwise, the emulsion layer vehicles are identical to those taught to be generally useful in preparing silver halide emulsion layers, illustrated by R-24 *Research Disclosure,* Vol. 176, January 1978, Item 17643, Section IX. *Research Disclosure* is published by Kenneth Mason Publications, Ltd., Emsworth, Hampshire P010 7DD, England.

The recent tabular grain emulsions have been observed to provide a large variety of photographic advantages, including, but not limited to, improved speed-granularity relationships, increased image sharpness, a capability for more rapid processing, increased covering power, reduced covering power loss at higher levels of forehardening, higher gamma for a given level of grain size dispersity, less image variance as a function of processing time and/or temperature variances, higher separations of blue and minus blue speeds, the capability of optimizing light transmission or reflectance as a function of grain thickness, and reduced susceptibility to background radiation damage in very high speed emulsions.

While the recent tabular grain emulsions have advanced the state of the art in almost every grain related parameter of significance in silver halide photography, one area of concern has been the susceptibility of tabular grain emulsions to vary in their photographic response as a function of the application of localized pressure on the grains. As might be intuitively predicted from the high proportion of less compact grain geometries in the recent tabular grain emulsions, pressure (e.g., kinking, bending, or localized stress) desensitization, a long standing concern in silver halide photography, is a continuing concern in photographic elements containing recent tabular grain emulsions.

It was recognized prior to the discovery of recent tabular grain emulsions that latices in general when incorporated into silver halide emulsion layers can contribute to reducing pressure desensitization. This teaching is illustrated by R-25 *Research Disclosure,* Vol. 195, July 1980, Item 19551.

SUMMARY OF THE INVENTION

It has been discovered that pressure desensitization of photographic elements containing these recent tabular grain emulsions can be dramatically reduced by incorporating in the emulsion layer one or more selected latices. For latices derived from methacrylate ester polymers dramatic reductions in pressure desensitization are achieved when the polymer is selected to exhibit a glass transition temperature of less than 50° C.

In one aspect this invention is directed to a photographic element comprised of a support and, coated on the support, at least one radiation-sensitive silver halide emulsion comprised of silver halide grains dispersed in a vehicle. At least 50 percent of the total proJected area of the silver halide grains is comprised of tabular grains satisfying the relationship:

$$ECD/t^2 > 25$$

where

ECD is the average equivalent circular diameter in μm of the tabular grains and t is the average thickness in μm of the tabular grains.

The vehicle is comprised of hydrophilic colloid forming a continuous Phase and a latex. The vehicle contains in an amount sufficient to reduce pressure sensitivity a latex consisting essentially of a methacrylate polymer having a glass transition temperature of less than 50° C.

DESCRIPTION OF PREFERRED EMBODIMENTS

The photographic elements of this invention are comprised of a support and, coated on the support, at least one radiation sensitive silver halide emulsion containing silver halide grains and a dispersing medium. At least 50 percent of the total projected area of the silver halide grains is comprised of tabular grains. Preferably at least 70 percent and optimally at least 90 percent of the total grain projected area in the emulsion layer is accounted for by tabular grains. The tabular grains satisfy relationships (1) and (3) above. The tabular and other silver halide grains, if present, of the tabular grain emulsions can take any of the various forms disclosed in teachings R-1 to R-23 inclusive, cited above and here incorporated by reference. The preferred emulsions are high aspect ratio tabular grain emulsions.

Emulsion layers satisfying the requirements of this invention can be most readily formed by adding to the tabular grain emulsions of any one of teachings R-1 to R-23 inclusive a specifically selected vehicle. As coated in photographic elements, the tabular grain silver halide emulsions typically contain silver halide grains and vehicle in a weight ratio in the range of about 2:1 to 1:2. As initially precipitated the emulsion contains at least some hydrophilic colloid acting as a grain peptizer. The simplest approach to preparing an emulsion for coating is to add hydrophilic colloid to bring the vehicle up to an optimum concentration for coating. As coated the hydrophilic colloid forms the continuous phase and the silver halide grains the dispersed phase of the silver halide emulsion layer.

An essential feature of the present invention is that the required tabular grain silver halide emulsion contains a second dispersed phase in the form of a latex. The hydrophilic colloid and the latex together form the vehicle of the required tabular grain silver halide emulsion layer.

The latex particles can be present in any concentration effective to reduce pressure desensitization of the tabular grain emulsion layer. Generally pressure desensitization is reduced as the proportion of latex is increased until pressure desensitization becomes too low to be measured. The optimum proportion of latex is at or near the minimum required for minimum pressure desensitization. The higher the degree of pressure desensitization in the absence of latex the higher the proportion of latex required to reach minimum pressure desensitization. The latex and hydrophilic colloid are typically present in the tabular grain emulsion layer in a weight ratio range of from 4:1 to 1:4, more commonly in the range of from 3:1 to 1:3, and most commonly in a weight ratio of 2:1 to 1:2.

From experimental investigation it has been determined that latices consisting essentially of a methacrylate polymer having a glass transition temperature of less than 50° C. are capable of reducing the pressure desensitization of tabular grain emulsions satisfying relationships (1) and (3). The methacrylate polymer preferably has a glass transition temperature of less than 35° C.

The glass transition temperature of a polymer is the temperature below which it exhibits the physical properties of a solid rather than a viscous liquid. The glass transition temperatures of polymers and techniques for their measurement are generally known in the art and form no part of this invention. Reference books typically publish the glass transition temperatures for homopolymers of common polymerizable monomers. The glass transition temperatures of copolymers (polymers containing two or more types of repeating units) can be estimated from a knowledge of the proportion of each repeating unit making up the copolymer and the published glass transition temperature of the homopolymer corresponding to each repeating unit. Representative glass transition temperatures for homopolymers have been published, for example, in the *Polymer Handbook,* 2nd Ed., in the Chapter by W. A. Lee and R. A. Rutherford, titled, "The Glass Transition Temperature of Polymers", beginning at page III-139, John Wiley & Sons, N.Y., 1975, the disclosure of which is here incorporated by reference.

As employed herein the term "methacrylate polymer" indicates a vinyl polymer having at least 50 percent by weight of its repeating units derived from one or more methacrylate esters. The methacrylate ester monomers providing the repeating units of the polymer can be conveniently formed by reacting methacrylic acid with an alcohol, phenol, or hydroxy substituted ether. It is generally preferred to select individual repeating units of the methacrylate polymer, including each methacrylate ester or other, optional repeating unit present, from those containing up to about 22 carbon atoms. When the methacrylate polymer is a copolymer, it is not essential that any one repeating unit present form a homopolymer having a glass transition temperature of less than 50° C., provided the copolymer as a whole satisfies this criterion.

In the simplest form of the invention the methacrylic polymer is a homopolymer of a methacrylic ester selected to exhibit a glass transition temperature of less than 50° C. Methacrylic esters capable of forming homopolymers exhibiting a glass transition temperature of less than 50° C. are also preferred methacrylate ester repeating units for the copolymers employed as latices in accordance with this invention.

In a preferred form the methacrylate ester repeating unit unit is derived from a monomer satisfying Formula 4.

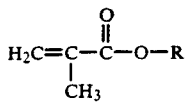

(4)

where

R is an ester forming moiety (e.g., the residue of an alcohol, phenol, or ether) containing from 3 to 12 carbon atoms, preferably from 4 to 10 carbon atoms. R can, for example, be any alkyl of from 3 to 12 carbon atoms; a benzyl group of from 7 to 12 carbon atoms, a cycloalkyl group of from 3 to 12 carbon atoms, preferably 5 to 7 carbon atoms; or a mono-oxy, di-oxy, or tri-oxy ether containing from 3 to 12 carbon atoms. Although the foregoing are preferred, it is appreciated that R in the various forms noted can contain up to about 18 carbon atoms when the repeating unit ranges up to 22 carbon atoms, as noted above.

Numerous other forms of the methacrylate ester group are, of course, possible. Choice of a specific methacrylate ester monomer is dictated by (1) the desired glass transition temperature of the methacrylate polymer, (2) the proportion of the methacrylate polymer the particular methacrylate ester constitutes, and (3) the effect of other repeating units, if any, on the overall glass transition temperature of the methacrylate polymer.

The methacrylate ester monomers set forth in Table I are illustrative of readily available monomers contemplated for inclusion as rePeating units of the methacrylate polymers of the latices employed to reduce pressure desensitization. In this and all subsequent tables setting out monomers for forming the methacrylate polymers of this invention, the Chemical Abstracts Service name and registry number is given, where available.

TABLE I

| | |
|---|---|
| Ma. | Benzyl methacrylate (2495-37-6) |
| Mb. | n-Butyl methacrylate (97-88-1) |
| Mc. | Isobutyl methacrylate (97-86-9) |
| Md. | Isopropyl methacrylate (4655-34-9) |
| Me. | n-Lauryl methacrylate (142-90-5) |
| Mf. | 3-Methyl-3-buten-2-one (814-78-8) |
| Mg. | 3-Methacryloyl-2,4-pentanedione |
| Mh. | Methyl methacrylate (80-62-6) |
| Mi. | 2-Hydroxyethyl methacrylate (868-77-9) |
| Mj. | n-Octadecyl methacrylate (32360-05-7) |
| Mk. | n-Octyl methacrylate (2157-01-9) |
| Ml. | Methoxyethyl methacrylate (6976-93-8) |
| Mm. | Phenyl methacrylate (2177-70-0) |
| Mn. | n-Propyl methacrylate (2210-28-8) |
| Mo. | 2-Hydroxypropyl methacrylate (923-26-2) |
| Mp. | Tetrahydrofurfuryl methacrylate (2455-24-5) |
| Mq. | 2-(Ethoxyethoxy)ethyl methacrylate (45127-97-7) |

TABLE I-continued

| | |
|---|---|
| Mr. | 2-Acetoxyethyl methacrylate (20166-49-8) |
| Ms. | 2-(tert-Butylamino)ethyl methacrylate (3775-90-4) |
| Mt. | 2-Ethylhexylmethacrylate (688-84-6) |
| Mu. | Ethyl methacrylate (97-63-2) |

The latices are intended to be dispersed in one or more hydrophilic colloids forming the continuous phase of the vehicle. It has been observed that the methacrylate polymers remain more uniformly dispersed in hydrophilic colloid vehicles during handling and storage when from about 1 to 10 percent, by weight, of the repeating units of the methacrylate polymer contain at least one highly polar pendant group. These repeating units can be derived from any convenient vinyl monomer having at least one pendant highly polar group. These vinyl monomers can be selected from among those having from 2 to 21 carbon atoms, preferably 3 to 10 carbon atoms. Illustrative of vinyl monomers of this class are those satisfying Formula 5.

$$V-(L)_m-P \quad (5)$$

where

V is a group having a vinyl unsaturation site;

L is a divalent linking group;

m is the integer 1 or 0; and

P is a highly polar pendant group.

In one preferred form the highly polar pendant group can be carboxylic acid carboxylic acid salt moiety (e.g., an ammonium or alkali metal carboxylate). The pendant group in this form can satisfy the Formula 6.

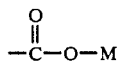

(6)

where M is hydrogen, ammonium, or an alkali metal. The monomers set out in Table II are illustrative of those capable of providing repeating units of this type.

TABLE II

| | |
|---|---|
| Ca. | 1-Propene-1,2,3 tricarboxylic acid (499-12-7) |
| Cb. | 2-Propenoic acid (79-10-7) |
| Cc. | 2-Propenoic acid, sodium salt (7446-81-3) |
| Cd. | 2-Chloro-2-propenoic acid (598-79-8) |
| Ce. | 2-Propenoic acid, 2-carboxyethyl ester (24615-84-7) |
| Cf. | 2-Methyl-2-propenoic acid (79-41-4) |
| Cg. | 2-Methyl-2-propenoic acid, lithium salt (13234-23-6) |
| Ch. | Methylenebutanedioic acid (97-65-4) |
| Ci. | 2-Butenedioic acid (110-16-7) |
| Cj. | 2-Methylbutenedioic acid (498-24-8) |
| Ck. | 2-Methylenepentendioic acid (3621-79-2) |

Generally regarded as more effective in imparting stabilization than the above class of pendant groups are sulfo or oxysulfo pendant groups. The pendant group in this form can satisfy the Formula 7.

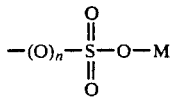

(7)

where

M is as previously defined and n is zero or 1.

The monomers set out in Table III are illustrative of those capable of providing repeating units of this type.

TABLE III

| | |
|---|---|
| Sa. | 2-Carboethoxyallyl sulfate, sodium salt |
| Sb. | 2-Propenoic acid, ester with 4-hydroxy-1-butanesulfonic acid, sodium salt (13064-32-9) |
| Sc. | 2-Propenoic acid ester with 4-hydroxy-2-butanesulfonic acid, sodium salt (15834-96-5) |
| Sd. | 3-Allyloxy-2-hydroxypropanesulfonic acid, sodium salt |
| Se. | 2-Methyl-2-propenoic acid ester with 3-[tert-butyl(2-hydroxyethyl)amino]propane sulfonic acid (14996-75-9) |
| Sf. | Ethenesulfonic acid, sodium salt (3039-83-6) |
| Sg. | Methylenesuccinic acid, diester with 3-hydroxy-1-propane sulfonic acid, disodium salt (21567-32-8) |
| Sh. | 2-Methyl-2-propenoic acid ester with 2-(sulfooxy)ethyl, sodium salt (45103-52-4) |
| Si. | N-3-Sulfopropyl acrylamide, potassium salt |
| Sj. | 2-Methyl-2-propenoic acid, 2-sulfoethyl ester (10595-80-9) |
| Sk. | 2-Methyl-2-propenoic acid, 2-sulfoethyl ester, lithium salt (52556-31-7) |
| Sl. | o-Styrene sulfonic acid, ammonium salt |
| Sm. | p-Styrene sulfonic acid, potassium salt (4551-90-0) |
| Sn. | p-Styrene sulfonic acid |
| So. | 4-4-Ethenylbenzenesulfonic acid, sodium salt (2695-37-6) |
| Sp. | 2-Propenoic cid, 3-sulfopropyl ester, sodium salt (15717-25-6) |
| Sq. | m-Sulfomethylstyrene sulfonic acid, potassium salt |
| Sr. | p-Sulfomethylstyrene sulfonic acid, sodium salt |
| Ss. | 2-Methyl-2-propenoic acid, 3-sulfopropyl ester, sodium salt (10548-16-0) |
| St. | 2-Methyl-2-propenoic acid, 3-sulfobutyl ester, sodium salt (64112-63-6) |
| Su. | 2-Methyl-2-propenoic acid, 4-sulfobutyl ester, sodium salt (10548-15-9) |
| Sv. | 2-Methyl-2-propenoic acid, 2-sulfoethyl ester, sodium salt (1804-87-1) |
| Sw. | 2-Methyl-2-[(1-oxo-2-propenyl)amino]-1-propanesulfonic acid (15214-89-8) |
| Sy. | 2-Methyl-2-[(1-oxo-2-propenyl)amino]-1-propanesulfonic acid, sodium salt (5165-97-9) |
| Sz. | 2-Methyl-2-[(1-oxo-2-propenyl)amino]-1-propanesulfonic acid, potassium salt (52825-28-2) |

In preparing emulsion and other hydrophilic colloid containing layers of photographic elements it is accepted practice to harden the hydrophilic colloid. This reduces the ingestion of water during processing, thereby decreasing layer swell and improving adherence of the layers to each other and the support. Conventional hardeners for the hydrophilic colloid containing layers of photographic elements are illustrated by *Research Disclosure,* Item 17643, cited above, Section X, the disclosure of which is here incorporated by reference. The methacrylate polymer latices incorporated in the emulsion layers of the photographic elements of this invention need not be hardenable, since the methacrylate polymer, unlike the colloid in which it is suspended, is hydrophobic and therefore does not pick up water during processing. However, it is a common practice to include in latices employed in the hydrophilic colloid layers of photographic elements at least a minor amount of repeating units capable of providing hardening sites.

In one preferred form the methacrylate polymers employed in the practice of this invention contain from about 5 to 20 percent by weight repeating units capable of providing hardening sites. Illustrative of vinyl monomers of this class are those satisfying Formula 8.

$$V-(L)_m-H \quad (8)$$

where

V is a group having a vinyl unsaturation site;

L is a divalent linking group;

m is the integer 1 or 0; and

H is a moiety providing a hardening site, such as an active methylene moiety, an aziridine or oxirane moiety, a primary amino moiety, or a vinyl precursor moiety.

Hardenable sites can be take a variety of forms. In a very common form the repeating unit can contain a readily displaceable hydrogen, such as an active methylene site, created when a methylene group is positioned between two strongly electron withdrawing groups, typically between two carbonyl groups or between a carbonyl group and a cyano group. Since the primary amino groups of gelatin, widely employed as a photographic hydrophilic colloid, provide hardening sites, it is also contemplated to incorporate in the methacrylate polymer to facilitate hardening repeating units that contain a primary amino group. Another approach to prOviding a hardening site is to incorporate a vinyl precursor moiety, such as a repeating unit that is capable of dehydrohalogenation in situ to provide a vinyl group. Monomers which at the time of polymerization contain two or more vinyl groups, such as divinylbenzene, are preferably avoided or minimized to reduce crosslinking of the methacrylate polymer. Stated another way, methacrylate polymers are preferred which prior to hardening are linear polymers. Moieties containing strained rings, such as aziridine and oxirane (ethylene oxide) rings, are also capable of providing active hardening sites.

The monomers set out in Table IV are illustrative of those capable of providing repeating units providing hardening sites.

TABLE IV

| | |
|---|---|
| Ha. | 2-Cyano-N-2-propenylacetamide (30764-67-1) |
| Hb. | 2-Methyl-2-propenoic acid, 2-aminoethyl ester, hydrochloride (2420-94-2) |
| Hc. | 2-Propenoic acid, 2-aminoethyl ester (7659-38-3) |
| Hd. | N-Methacryloyl-N'-glycylhydrazine hydrochloride |
| He. | 5-Hexene-2,4-dione (52204-69-0) |
| Hf. | 5-Methyl-5-Hexene-2,4-dione (20583-46-4) |
| Hg. | 2-Methyl-2-propenoic acid, 2-[(cyanoacetyl)-oxy]ethyl ester (21115-26-4) |
| Hh. | 2-Propenoic acid, oxidranylmethyl ester (106-90-1) |
| Hi. | 2-Methyl-2-propenoic acid, oxidranylmethyl ester (106-90-2) |
| Hj. | Acetoacetoxy-2,2-dimethylpropyl methacrylate |
| Hk. | 3-Oxo-4-pentenoic acid, ethyl ester (224105-80-0) |
| Hl. | N-(2-Aminoethyl)-2-methyl-2-propenamide, monohydrochloride (76259-32-0) |
| Hm. | 3-oxo-butanoic acid, 2-[(2-methyl-1-oxo-2-propenyl)oxy]ethyl ester (21282-97-3) |
| Hn. | 2-Propenamido-4-(2-chloroethylsulfonyl-methyl)benzene |
| Ho. | 3-(2-ethylsulfonylmethyl)styrene |
| Hp. | 4-(2-ethylsulfonylmethyl)styrene |
| Hq. | N-(2-Amino-2-methylpropyl)-N'-ethenyl-butanediamide (41463-58-5) |
| Hr. | Propenamide (79-06-1) |

Still other repeating units can be incorporated in the methacrylate polymers of this invention, so long as the glass transition temperature of the polymer is maintained at less than 10° C. and the methacrylate ester repeating units are present in a concentration of least 50 percent by weight. The other repeating units can be employed to adjust the glass transition temperature of the polymer or to adjust hydrophobicity or hydrophilicity for a specific application. Styrenic repeating units (including repeating units derived from styrene and styrene substituted by hydrogen displacement, such as halo and alkyl substituted styrene monomers) and acrylamides (including halo and alkyl substituted acrylamides (e.g., methacrylamides and N hydroxyalkylacrylamides) are particularly contemplated. The styrenic repeating units necessarily contain at least 8 and preferably contain up to about 16 carbon atoms. The acrylamides and substituted acrylamides require only 2 carbon atoms and preferably contain up to about 10 carbon atoms, optimally up to about 6 carbon atoms.

The monomers set out in Table V are illustrative of simple repeating units that can be employed to modify the hydrophobicity of the methacrylate polymers.

TABLE V

| | |
|---|---|
| Oa. | Styrene |
| Ob. | (1-Methylethenyl)benzene (98-83-9) |
| Oc. | 3-Chloromethylstyrene |
| Od | 4-Chloromethylstyrene |
| Oe. | 3-Octadecyloxystyrene |
| Of. | 4-Octadecyloxystyrene |
| Og. | N-(3-Hydroxyphenyl)-2-methyl-2-propenamide (14473-49-5) |
| Oh. | 2-Propenoic acid, 2-hydroxethyl ester (818-61-1) |
| Oi. | 2-Propenoic acid, 2-hydroxypropyl ester |
| Oj. | N-(1-Methylethyl)-2-propenamide (2210-25-5) |
| Ok. | 3-Ethenylbenzoic acid |
| Ol. | 4-Ethenylbenzoic acid |
| Om. | N-(2-Hydroxypropyl)-2-methyl-2-propenamide (21442-01-3) |
| On. | N,2-Dimethyl-2-propenamide (3887-02-3) |
| Op. | 2-Methyl-2-propenamide (79-39-0) |
| Oq. | N-(2-Hydroxypropyl)-2-methyl-2-propenamide (21442-01-3) |
| Or. | N-[2 hydroxy-1,1-bis(hydroxymethyl)ethyl]-2-propenamide (13880-05-2) |
| Os. | N-(1,1-Dimethylethyl)-2-propenamide (107-58-4) |
| Ot. | Acetic acid ethenyl ester (108-05-4) |
| Ou | 3-Methylstyrene |
| Ov. | 4-Methylstyrene |
| Ow. | N,N-dimethyl-2-propenamide (2680-03-7) |

In addition to being selected to reduce pressure desensitization the latices employed in the emulsion layers can also be used as carriers for hydrophobic emulsion addenda. A wide variety of hydrophobic photographic addenda that can be associated with the couplers are disclosed in *Research Disclosure* Item 19551, cited above, the disclosure of which is here incorporated by reference.

While any conventional hydrophilic colloid peptizer or combination of peptizers can be employed in combination with one or more methacrylate polymer latices selected to satisfy the glass transition temperature requirements, preferred peptizers for use in the practice of this invention are gelatino-peptizers—e.g., gelatin and modified gelatin (also referred to as gelatin derivatives). Useful hydrophilic colloid peptizers including gelatino-peptizers are disclosed in *Research Disclosure,* Item 17643, Section IX, cited above. Paragraph A, here incorporated by reference. Of the various modified forms of gelatin, acetylated gelatin and phthalated gelatin constitute preferred gelatin derivatives. Specific useful forms of gelatin and gelatin derivatives can be chosen from among those disclosed by Yutzy et al U.S. Pat. No. 2,614,928 and 2,614,929; Lowe et al U.S. Pat. Nos. 2,614,930 and 2,614,931; Gates U.S. Pat. Nos. 2,787,545 and 2,956,880; Ryan U S. Pat. No. 3,186,846; Dersch et al U.S. Pat. No. 3,436,220; Luciani et al U.K. Pat. 1,186,790; and Maskasky U.S. Pat. No. 4,713,320.

To reduce pressure desensitization it is only required that a single tabular grain silver halide emulsion layer satisfying the requirements of this invention be present. However, if the photographic element contains two or more tabular emulsion layers, it is preferred that each contain a methacrylate Polymer selected to satisfy the glass transition requirements noted above. This is particularly preferred in color photographic elements, where the match of sensitivities in different color forming layer units of the photographic element can be as important as their absolute sensitivities.

In addition to at least one emulsion layer satisfying the requirements of the invention, the photographic elements include a support onto which the emulsion layer is coated. Any convenient conventional photographic support can be employed. Useful photographic supports include film and paper supports. Illustrative photographic supports are disclosed in *Research Disclosure,* Item 17643, cited above, Section XVII, here incorporated by reference.

Apart from the features specifically noted the photographic elements of this invention can employ any of the features characteristically included in color (including especially full multicolor) photographic elements which produce dye images and photographic elements which produce silver images, such as black-and-white photographic elements, graphic arts photographic elements, and radiographic elements intended to produce images by direct X-radiation exposure or by intensifying screen exposure. The emulsion and other layer features characteristic of photographic elements of these types are summarized in the remaining sections *Research Disclosure,* Item 17643, cited above, and here incorporated by reference.

EXAMPLES

The invention can be better appreciated by reference to the following specific examples.

A silver bromoiodide (4 mole percent iodide, based on silver) high aspect ratio tabular grain emulsion with an ECD of 3.6 μm and an average thickness t of 0.14 μm was prepared. The tabular grains accounted for more than 50% of the total grain projected area. $ECD/t^2$ of the emulsion tabular grains was 184. The emulsion was spectrally sensitized with a green sensitizing dye and chemically sensitized with a sulfur plus gold finish.

A first control coating (C-1) of the emulsion was prepared on a photographic film support at 1.6 $g/m^2$ silver, 1.62 $g/m^2$ gelatin, and 0.756 $g/m^2$ magenta coupler. This coating did not satisfy the requirements of the invention in that it lacked an incorporated latex.

A second control coating (C-2) of the emulsion was prepared identical to the first control coating, except for the addition of 1.62 $g/m^2$ of a methacrylate ester polymer latex having a glass transition temperature ($t_g$) of 118° C., too high to satisfy the requirements of the invention. The methacrylate ester polymer consisted of the following repeating units:

| | |
|---|---|
| Mh. | Methyl methacrylate |
| Sy. | 2-Methyl-2-[(1-oxo-2-propenyl)amino]-1-propanesulfonic acid, sodium salt |
| Hm. | 3-Oxo-butanoic acid, 2-[(2-methyl-1-oxo-2-propenyl)oxy]ethyl ester |

The MhSyHm repeating units were present in the weight ratio (88:5:7).

A third control coating (C-3) of the emulsion was prepared identically as the second control coating, except MuSyHm (88:5:7) was substituted for MhSyHm, where

| | |
|---|---|
| Mu. | Ethyl methacrylate. |

The $t_g$ of the methacrylate ester polymer was 80° C.

A first example coating (E-1) was prepared identically as the second control coating, except MbSyHm (88:5:7) was substituted for MhSyHm, where

| | |
|---|---|
| Mb | n-Butyl methacrylate |

The $t_g$ of the methacrylate ester polymer was 40° C.

A second example coating (E-2) was prepared identically as the second control coating, except MtSyHm (88:5:7) was substituted for MhSyHm, where

| | |
|---|---|
| Mt. | 2-Ethylhexylmethacrylate |

The $t_g$ of the methacrylate ester polymer was −23° C.

The coatings were identically subjected to a nominal pressure of 10,000 psi (689.5 MPa). The coatings were then processed for 3 minutes 15 seconds using the Kodak Flexicolor C-41 ® color process, a process employing a p-phenylene diamine color developing agent, described in detail in the *British Journal of Photography Annual*, 1977, pp. 205–206, here incorporated by reference.

The results are summarized below in Table VI. To obtain a reference density for purposes of comparison the maximum and minimum densities of each coating were measured, added, and divided by 2. The difference between the density of each coating with and without being subJected to pressure as described above was measured. This density difference was then contrast normalized by dividing by the contrast ($\gamma$).

TABLE VI

| Latex | $t_g$ | ΔD | % ΔD Reduction |
|---|---|---|---|
| None (C-1) | N.A. | −0.094 | N.A. |
| MhSyHm (88:5:7)(C-2) | 118° C. | −0.122 | 0 |
| MuSyHm (88:5:7)(C-3) | 80° C. | −0.097 | 0 |
| MbSyHm (88:5:7)(E-1) | 40° C. | −0.054 | 42.6 |
| MtSyHm (88:5:7)(E-2) | −23° C. | −0.045 | 52.1 |

Table VI shows that the methacrylate ester polymer latices having a glass transition temperature of above 50° C. gave no measurable reduction in pressure sensitivity. On the other hand, with each of the methacrylate ester latices present having a glass transition temperature below 50° C. a dramatic reduction in pressure desensitization was observed.

The comparisons described above were repeated, but with a silver bromoiodide (12 mole percent iodide) emulsion having nontabular grains (grains in which ECD and t differed by less than 2:1). Coating coverages differed from those reported above by less than 1 percent. The results are summarized in Table VII.

TABLE VII

| Latex | $t_g$ | ΔD | % ΔD Reduction |
|---|---|---|---|
| None (C-4) | N.A. | −0.157 | N.A. |
| MhSyHm (88:5:7)(C-5) | 118° C. | −0.178 | 0 |
| MuSyHm (88:5:7)(C-6) | 80° C. | −0.178 | 0 |
| MbSyHm (88:5:7)(C-7) | 40° C. | −0.171 | 0 |
| MtSyHm (88:5:7)(C-8) | −23° C. | −0.092 | 41.4 |

By comparing the data in Table VI, which demonstrates the effect of latices of varying glass transition temperatures in tabular grain emulsions, with the data in Table VII, which substitutes nontabular grain emulsions containing the same latices, it is apparent that reduction of desensitization is achieved in the tabular grain emulsions with methacrylate polymers having higher glass temperatures than are effective in the nontabular grain emulsions. From Table VI it is apparent that from a temperature of from less than about 50° C. to −20° C. methacrylate polymers are useful in reducing pressure desensitization in tabular grain emulsions, but the data in Table VII does not support this conclusion for corresponding nontabular grain emulsions. The data in Tables VI and VII further demonstrate that methacrylate polymers having glass transition temperatures of less than −20° C. are still more effective in reducing pressure desensitization in tabular grain emulsions than in nontabular grain emulsions. In every instance the methacrylate polymers having glass transition temperatures of less than 50° C. produce superior results in tabular grain emulsions.

The invention has been described in detail with particular reference to preferred embodiments thereof, but it will be understood that variations and modifications can be effected within the spirit and scope of the invention.

What is claimed is:

1. A photographic element comprised of a support and, coated on the support, at least one radiation-sensitive silver halide emulsion comprised of silver halide grains dispersed in a vehicle, at least 50 percent of the total projected area of the silver halide grains being comprised of tabular grains satisfying the relationship:

$$ECD/t^2 > 25$$

where

ECD is the average equivalent circular diameter in μm of the tabular grains and t is the average thickness in μm of the tabular grains, and the vehicle being comprised of hydrophilic colloid forming a continuous phase and a latex, characterized in that the vehicle contains in an amount sufficient to reduce pressure sensitivity a latex consisting essentially of a methacrylate polymer selected to have a glass transition temperature of less than 50° C.

2. A photographic element according to claim 1 further characterized in that the methacrylate polymer is selected to have a glass transition temperature of less than 35° C.

3. A photographic element according to claim 2 further characterized in that the methacrylate polymer is selected to have a glass transition temperature of less than −20° C.

4. A photographic element according to claim 1 further characterized in that the weight ratio of latex to hydrophilic colloid is in the range of from 4:1 to 1:4.

5. A photographic element according to claim 4 further characterized in that the weight ratio of latex to hyrophilic colloid is in the range of from 3:1 to 1:3.

6. A photographic element according to claim 1 further characterized in that at least 50 percent by weight of the repeating units forming the methacrylate polymer are derived from methacrylate ester monomers containing up to 22 carbon atoms.

7. A photographic element according to claim 6 further characterized in that said methacrylate ester monomers are selected to satisfy the formula:

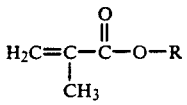

where R is an ester forming moiety containing from 3 to 12 carbon atoms.

8. A photographic element according to claim 7 further characterized in that R is an ester forming moiety contains from 4 to 10 carbon atoms.

9. A photographic element according to claim 6 further characterized in that 5 to 20 percent by weight of the methacrylate polymer is formed of repeating units providing hardening sites.

10. A photographic element according to claim 9 further characterized in that hardening sites are provided by moieties selected from the group consisting of active methylene, azirdine or oxirane, primary amine, and vinyl precursor moieties.

11. A photographic element according to claim 6 further characterized in that 1 to 10 percent by weight of the methacrylate polymer is formed of repeating units containing polar pendant groups chosen from the class consisting of

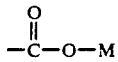

and

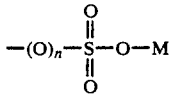

where

M is hydrogen, alkali metal or ammonium and n is zero or 1.

12. A photographic element according to claim 1 further characterized in that said tabular grains have an average aspect ratio of greater than 8:1.

13. A photographic element according to claim 1 further characterized in that the methacrylate polymer is selected to have a glass transition temperature in the range of from less than 50° C. to −20° C.

* * * * *